United States Patent [19]

Roffe et al.

[11] 4,008,041

[45] Feb. 15, 1977

[54] APPARATUS FOR THE GAS PHASE COMBUSTION OF LIQUID FUELS

[76] Inventors: Gerald Alton Roffe, 3 Markwood Lane, East Northport, N.Y. 11731; Horacio Andres Trucco, 13 Sadler Court, Huntington Station, N.Y. 11746

[22] Filed: Oct. 2, 1975

[21] Appl. No.: 618,966

[52] U.S. Cl. ..... 431/247; 431/11; 431/208; 431/209; 431/210

[51] Int. Cl.[2] ..... F23D 11/44

[58] Field of Search ..... 431/11, 208, 209, 210, 431/211, 232, 236, 242, 247, 248

[56] References Cited

UNITED STATES PATENTS

| | | | |
|---|---|---|---|
| 3,047,054 | 7/1962 | Hunter et al. | 431/209 |
| 3,326,262 | 6/1967 | Weller et al. | 431/11 |
| 3,653,794 | 4/1972 | Shakiba | 431/208 |
| 3,840,321 | 10/1974 | Muench | 431/242 |

*Primary Examiner*—Edward G. Favors

[57] ABSTRACT

An arrangement to produce high efficiency gas phase combustion of liquid fuels. A liquid fuel, such as conventional heating oil, is pumped through a heat exchanger immersed in a liquid bath whose temperature is maintained at a level which is sufficiently high to cause the fuel to gassify but low enough to preclude undesirable chemical decomposition. The liquid bath is contained within an element which is directly exposed to a flame produced by the combustion of the gasified liquid fuel. The liquid bath temperature is controlled by varying the amount of surface area exposed to the flame or by internal forced circulation of the bath liquid. The gasified fuel is injected into an air or oxidizing gas stream and allowed to premix prior to combustion. Combustion is initiated by a spark or pilot flame and is stabilized by a flameholder. By eliminating liquid phase fuel from the flame zone and premixing with air, the apparatus produces a clean flame, free of solid carbon particles, with extremely low levels of carbon monoxide, unburned hydrocarbons and nitric oxide. In essence, the flame exhibits all the desirable characteristics of premixed gas phase combustion.

8 Claims, 4 Drawing Figures

APPARATUS FOR THE GAS PHASE COMBUSTION OF LIQUID FUELS

SUMMARY

Figure 1:
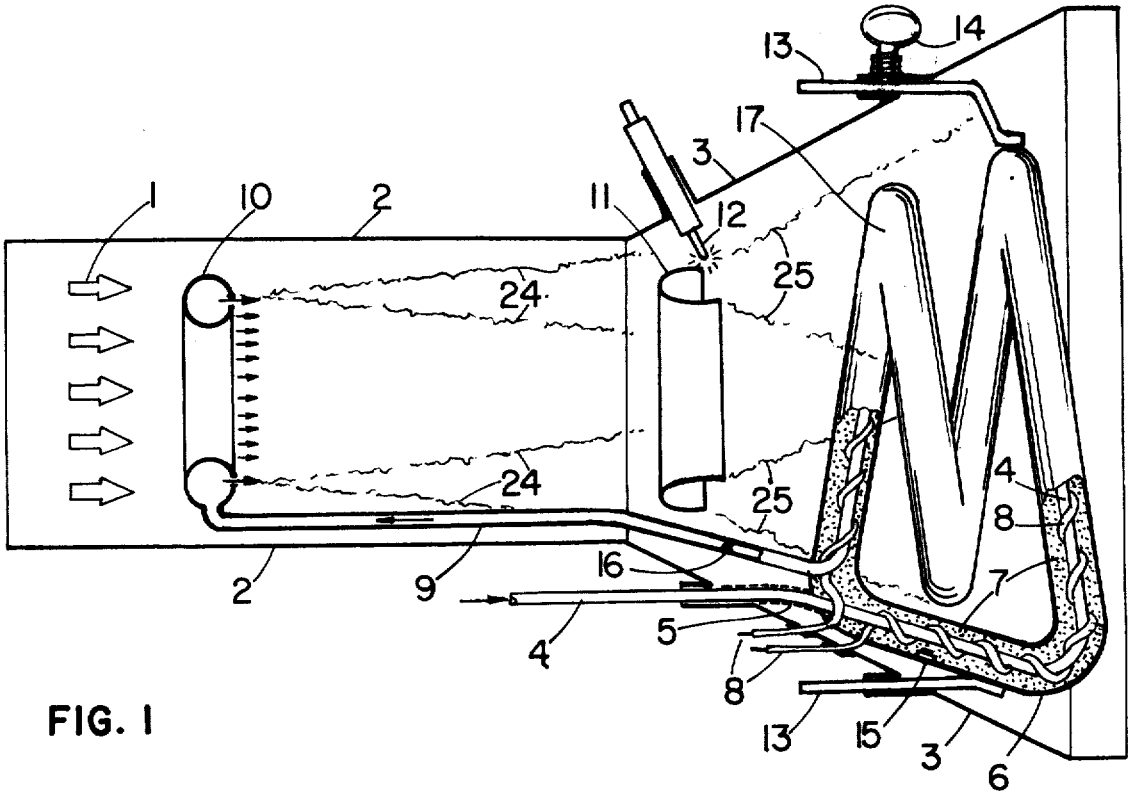

Achieving high thermal efficiency in a given combustion heating application requires the ability to minimize the amount of air utilized in excess of that required for stoichiometric combustion. Attempts to burn liquid fuels using atomization techniques at low levels of excess air generally results in the formation of unacceptably high levels of solid carbon (soot), carbon monoxide, nitric oxide and unburned hydrocarbons. These undesirable emissions are a direct result of the presence of liquid droplets in the combustion zone. The high temperature which prevails in most regions of the combustion zone causes liquid hydrocarbons to crack, producing solid carbon which is extremely difficult to remove completely by further oxidation. Fuel droplets reaching the cooler regions of the combustion zone fail to evaporate completely in the time available for combustion and can produce excessive levels of carbon monoxide and unburned hydrocarbons as a result.

By gasifying liquid fuel in a heat exchanger, the evaporation process can be carried out under uniform and controlled conditions. However, any process involving the heating of common liquid hydrocarbon fuels must be carried out with great care to avoid cracking. In this application, cracking is avoided by limiting the temperature rise of the fuel. For the particular case of No. 2 heating oil, a temperature of approximately 800° F is below the point of incipient decomposition but is sufficient to produce gasification. This temperature limitation applies to more than just the bulk fuel temperature, it applies to local fuel temperature everywhere within the gasification duct. This restriction can only be met if the temperature of the medium in which the fuel gasification duct is immersed is no greater than 800° F. Since the temperature of the combustion zone, the source of all heat used in this apparatus, is far greater than 800° F, an intermediate heat exchange step is employed. In this step, heat is transferred from the combustion zone to an intermediate fluid. By selecting a fluid which is not adversely affected by high temperature, the walls of its container may be placed in direct contact with the combustion zone. A sufficient bulk of intermediate fluid is provided to form an isothermal bath in which the fuel gasification duct is immersed. The heat input rate from the combustion zone to the bath is controlled to limit the bath temperature 800° F or the level appropriate for the particular liquid fuel being utilized..

The gas phase fuel produced by the gasification duct is premixed with air prior to combustion so that gas phase cracking or decomposition reactions within the combustion zone are accompanied by partial oxidation to preclude the formation of solid carbon. The combination of isothermal gasification of liquid fuel and premixing with air prior to combustion allows the use of a liquid fuel to produce a flame with the characteristics and advantages of a gaseous fuel, that is, extremely clean combustion with a light blue to pale yellow color, capable of burning with very little excess air as well as with considerable excess air. The apparatus may be employed in a variety of applications ranging from high efficiency heating equipment to direct firing of equipment presently requiring gaseous fuels. It can also be employed in low emission combustion applications such as fume incinerators or gas turbine combustors where premixed prevaporized flames have been shown to be an effective method of reducing the emission of nitrogen oxides. The application of the apparatus is not limited to hydrocarbon fuels and may be advantageously employed for any liquid fuel which may be adversely affected by being subjected to excessive temperature during the gasification process.

The structure of the apparatus of this invention will be understood by reference to the attached drawings.

FIG. 1 shows the details of a burner configuration employing a coil shaped gasification unit with a natural convection bath and provision to preheat the bath with an electrical resistance preheater.

Figure 2:
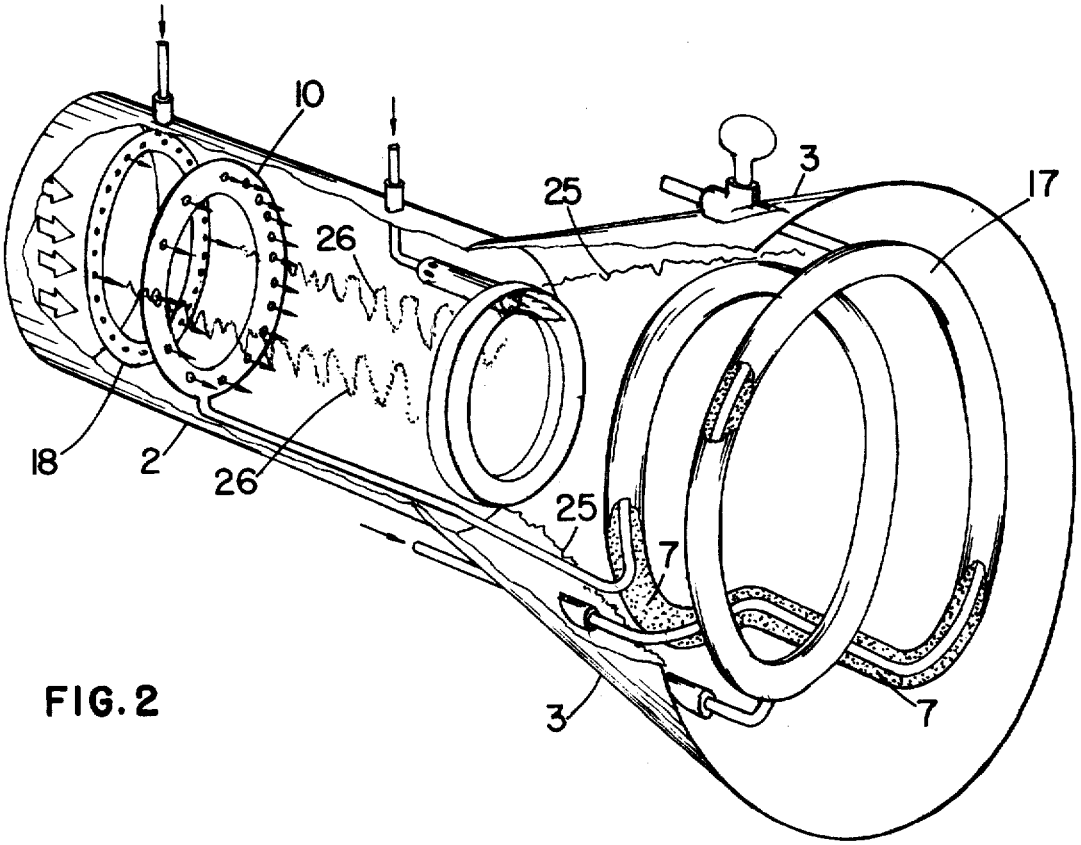
Figure 3:
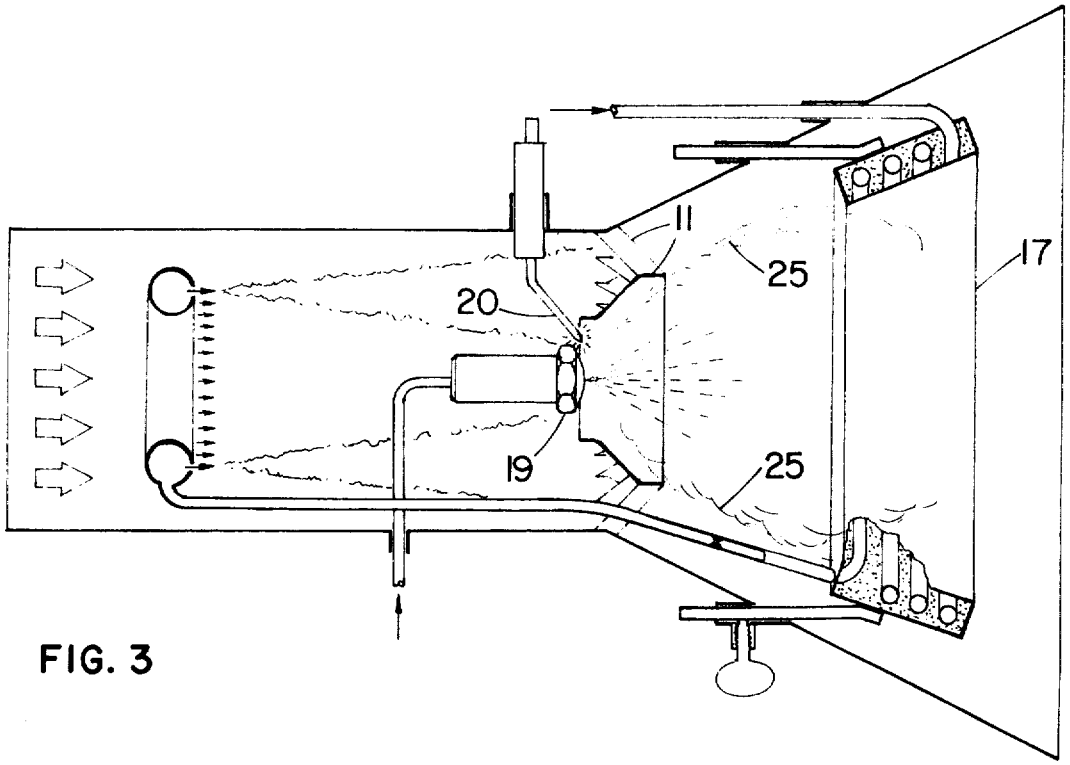

FIGS. 2 and 3 also show burners with natural convection gasification units but employing gas and oil flame preheaters.

Figure 4:
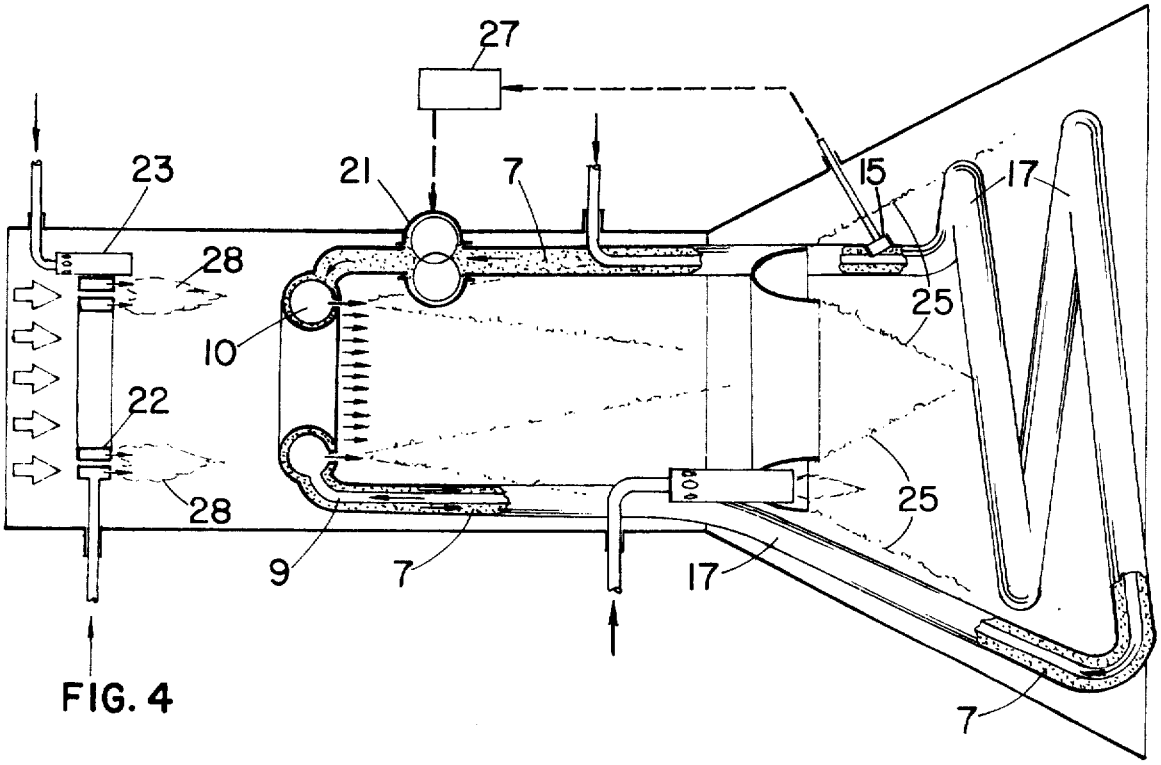

FIG. 4 presents the details of a burner configuration employing a forced circulation isothermal gasification unit with provision to preheat the unit with a gas flame.

FIG. 5 shows an alternate forced convection design employing an oil-fired preheater.

Referring to FIG. 1, a longitudinal cross section of a typical burner. A flow of air 1, or any gaseous mixture containing an oxidizer, established by natural or forced draft, is channeled through the mixer tube 2 which connects with the diffuser section 3. Liquid fuel is supplied from a reservoir by a pump, not shown, and enters the apparatus through the liquid fuel line 4 which is protected by an outer sheath of thermal insulation 5. The natural convection isothermal gasification unit 17 consists of a closed loop of coiled tubing 6 displaced laterally from the centerline of the burner and filled with a suitable heat exchange material 7. It is constructed so as to form a closed loop which will allow the continuous recirculation of the heat exchange material. The heat exchange material may be any of several suitable substances which satisfy the requirements of liquid state at the bath operating temperature and good heat exchange characteristics, ranging from low melting point metals or metal alloys to suitable inorganic salts. The liquid fuel supply line 4 and an electric resistance preheater 8 enter the isothermal gasifier unit 17 and extend internally through its entire length. The liquid fuel supply line 4 is separated from the thermally insulated gasified fuel delivery line 9 by the constricting orifice 16. The gasified fuel delivery line leads directly to the fuel distribution ring 10 which is provided with a plurality of small exit holes. A flameholder 11 is located downstream of the fuel distribution ring, within the fuel-oxidizer mixing region 24, the distance between the two being sufficient to allow the injected fuel to mix with the oxidizing gaseous stream. Ignition of the combustible mixture is accomplished by the igniter 12, shown in FIG. 1 as a high voltage electric spark, however any of several suitable means of ignition may be employed without affecting the nature of this invention. The isothermal gasification unit 17 is positioned within the combustion region 25 by a movable bracket 13 secured to the diffuser 3 by a locking device 14. A temperature sensor 15 is embedded within the heat exchange material 7 and measures its temperature.

Operation of the burner is initiated by energizing the electric resistance preheater 8 and allowing the isothermal gasification unit 17 to attain the desired operating temperature. Selection of the appropriate gasification temperature depends upon the physical and chemical properties of the fuel. The temperature must exceed the maximum boiling point of the fuel but must be less than the temperature at which thermal decomposition or cracking is initiated. The latter restriction is extremely important, as exceeding the cracking temperature locally will cause the accumulation of residue within the fuel line 4 of the gasification unit even if the average temperature of the fuel is below the cracking point. By employing a heat exchange bath and limiting the bath temperature to a value below the fuel cracking point, it is not possible to inadvertantly produce fuel decomposition by uneven heating. When the bath reaches the proper temperature, the preheater 8 is deenergized and liquid fuel is pumped into the line 4. By the time the fuel leaves the constricting orifice 16 it has reached a temperature sufficient to cause it to gasify completely. Passage through the constricting orifice allows the gas pressure to drop, making subsequent recondensation of the fuel more difficult. The gasified fuel is injected into the oxidizing stream by the distribution ring 10 and mixes with the stream in the mixer tube 2. The mixture is ignited at the flameholder 11 and the flame spreads downstream throughout the entire flow field. Since the isothermal gasification unit 17 is located within the combustion region 25, but displaced laterally from the flame axis, it receives an asymmetric distribution of heat. This uneven heating produces a natural convection current of the heat exchange material 7. This convective current provides a mechanism to avoid substantial temperature nonuniformities in the bath. The position of the gasification unit is adjusted using the bracket 13 and locking device 14 such that the overall heat transfer rate maintains the bath temperature at the preselected level. Adjustment of the bath temperature is facilitated by the use of the sensor 15.

The diameter of the mixer tube 2 must be such as to insure a stream velocity sufficiently high to avoid flame flashback into the mixing region 24. The geometry of the diffuser section 3 is chosen to produce a flame shape appropriate to the burner function but is not critical to this invention. Although a semitoroidal flameholder 11 is shown as a preferred embodiment, a variety of flameholding devices may be employed without compromising the spirit of this invention. It will be understood by those skilled in the art that the specific means to create the oxidizer flow, 1, the design of the igniter 12 and the nature of the temperature sensor 15 may be changed without altering the nature of this invention.

FIG. 2 presents an embodiment of this invention which employs an auxilliary supply of a gaseous fuel such as natural gas, liquid propane, etc., to preheat the isothermal gasification unit 17. The gaseous fuel is injected through the preheat distribution ring 18 and mixes with the oxidizer stream in region 26 as it flows through the mixer tube 2. The auxilliary gaseous fuel burns in region 25 and supplies the heat necessary to bring the isothermal gasification unit to the preselected operating temperature. When that temperature is attained, the auxilliary gas flow is terminated and liquid fuel enters the device to continue combustion in region 25. FIG. 2 also illustrates an alternate method of achieving the asymmetric heating of the isothermal gasification unit necessary to produce natural convection of the heat exchange material 7. In this embodiment, the isothermal gasification unit 17 is symmetrically disposed within the diffuser 3, however, the distribution ring 10 is provided with an asymmetric distribution of injection holes and will therefore produce a greater flame intensity on one side of the burner.

FIG. 3 shows an additional embodiment employing a natural convection isothermal gasification unit. In this embodiment, the gasification unit 17 is preheated by a flame 25 produced using the same liquid fuel employed as the primary burner fuel. In this case, operation is initiated by supplying liquid fuel to the atomizing nozzle 19 and igniting the fuel with a spark produced by the electrodes 20. The flameholder 11 is formed by a central cup surrounding the atomizing nozzle 19 and a set of peripheral swirl vanes. When the isothermal gasification unit 17 reaches the proper operating temperature, fuel flow to the unit is initiated and gas phase combustion begins. Fuel flow to the atomizing nozzle 19 continues until the flame produced by the gasified fuel is established, providing a pilot flame during transition. Once the gas phase flame is established the fuel flow to the atomizing nozzle 19 is terminated. The flameholder 11 used to establish the atomized liquid flame also serves to anchor the gas phase flame. FIG. 4 shows an embodiment of this invention which employs an isothermal gasification unit 17 with a forced circulation bath. In this case, the gasification unit axis can coincide with that of the flame 25 and circulation of the heat exchange material 7 is affected by the use of a circulating pump 21. This allows the heat exchange material 7 to be circulated over the entire length of the fuel circuit, including the distribution ring 10. This design provides an accurate and flexible fuel temperature control by linking the circulating pump 21 to the temperature sensor 15 by means of an on-off relay or proportional controller 27. Increasing the circulation rate of the heat exchange material 7 will increase the rate of heat transfer from the flame to the flowing fuel and thus the temperature of the gasifying fuel. Therefore, controlling the circulating pump 21 will control the fuel temperature. Moreover, by extending the heat transfer bath circuit to envelop the gasified fuel delivery line 9 and distribution ring 10, the possibility of fuel recondensation is eliminated. This embodiment of the invention is particularly useful when the capability to produce a large variation in fuel flow rate is required, such as in a burner with a very large turn-down ratio. The embodiment in FIG. 4 employs an auxilliary gaseous fuel preheater 22 and igniter 23 to produce a preheating flame 28. The preheater and igniter may be of any conventional design and it is clear that changing the nature of these devices does not affect the operation of the invention. Thus, any of several means may be employed to preheat the heat exchange bath, including electric resistance heaters, steam jackets or a liquid fuel flame preheater.

Various changes and modifications may be made without departing from the spirit of this invention and the scope thereof as defined in the following claims.

What we claim is:

1. An apparatus for the controlled temperature gasification of a liquid fuel, injection and mixing of the gasified fuel with air or gaseous oxidizer and combustion of that mixture comprising, in combination, a closed loop of heat transfer tubing disposed with lateral asymmetry with respect to the centerline of the apparatus, said tubing containing a heat transfer material which is a liquid at the fuel vaporization temperature, a temperature sensor within said heat transfer material, a fuel gasification tube passing through said heat transfer material, an orifice at the exit of said fuel gasification tube, a thermally insulated tube connecting the exit of said fuel gasification tube with a hollow gaseous fuel distribution ring equipped with a plurality of symetrically disposed holes, flameholder and ignition means positioned downstream of said fuel distribution ring such that the resulting flame impinges upon the heat transfer tubing, an adjustable bracket supporting said heat transfer tubing such that the position of the tubing with respect to said flame may be varied so as to produce any desired temperature of the heat transfer material contained within said heat transfer tubing.

2. The combination of claim 1 and wherein an electrical resistance heater is contained within the heat transfer tubing and passes through the heat transfer material within said tubing in order to bring said heat transfer material to a preset operating temperature.

3. The combination of claim 1 and wherein a hollow ring provided with a plurality of small holes is disposed upstream of the gasified fuel distribution ring and means to supply this ring with a gaseous fuel.

4. The combination of claim 1 and wherein a liquid fuel atomizing nozzle is disposed to produce a flame, anchored by the flameholder and means to provide said atomizing nozzle with liquid fuel.

5. The combination of claim 1 wherein said hollow gaseous fuel distribution ring is equipped with a plurality of holes disposed with lateral asymmetry.

6. An apparatus for the controlled temperature gasification of a liquid fuel, injection and mixing of the gasified fuel with air or gaseous oxidizer and combustion of that mixture comprising in combination, a closed loop of heat transfer tubing, said tubing containing a heat transfer material which is a liquid at the fuel vaporization temperature, a pump means for circulating said heat transfer material through said heat transfer tubing, a temperature sensor within said heat transfer material, said temperature sensor and pump means for circulating heat transfer material being connected through a controller which adjusts the pumping rate to maintain a preset temperature within said heat transfer material, a fuel gasification tube passing through said heat transfer material, an orifice at the exit of said fuel gasification tube, a hollow gaseous fuel distribution ring equipped with a plurality of symetrically disposed holes, flameholder and ignition means positioned downstream of said fuel distribution ring such that the resulting flame impinges upon the heat transfer tubing.

7. The combination of claim 6 and wherein a gas fuel burner means is positioned upstream of said gasified fuel distribution ring in order to bring said heat transfer material to a preset operating temperature.

8. The combination of claim 6 and wherein a liquid atomizing nozzle, flameholder and ignition means are positioned upstream of said gasified fuel distribution ring in order to bring said heat transfer material to a preset operating temperature.

* * * * *